United States Patent [19]

Brown et al.

[11] Patent Number: 4,852,954

[45] Date of Patent: Aug. 1, 1989

[54] STEP-FRONT CABINET WITH IMPROVED OVERHANGING COVER AND TRAY RETAINER

[75] Inventors: Allen C. Brown; Ray R. Brown, both of Jasper; J. Marshall Suttles, Elberton, all of Ga.

[73] Assignee: Royston Corporation, Royston, Ga.

[21] Appl. No.: 198,849

[22] Filed: May 26, 1988

[51] Int. Cl.[4] ..... A40B 96/18

[52] U.S. Cl. ..... 312/140.4; 52/73; 52/74

[58] Field of Search ..... 312/140.4, 281, 3, 1, 312/211; 108/108; 150/52 R; 52/73, 74

[56] References Cited

U.S. PATENT DOCUMENTS

| | | | |
|---|---|---|---|
| 2,388,949 | 11/1945 | Bloxham | 52/73 X |
| 2,539,335 | 1/1951 | Smith | 312/140.4 |
| 2,539,381 | 1/1971 | Heaney | 312/140.4 X |
| 4,013,880 | 3/1977 | Kennedy | 312/140.4 X |
| 4,137,536 | 2/1979 | Greene | 52/73 |
| 4,489,996 | 12/1984 | Norton et al. | 312/140.4 X |

*Primary Examiner*—Joseph Falk

*Attorney, Agent, or Firm*—Howson & Howson

[57] ABSTRACT

A protective cover for the stepped-down shelf of a step-front cabinet is provided by a transparent plastic cover sheet, a pair of cover sheet supports which engage the cover sheet at its opposite ends, and a pair of forwardly-extending rods fixed to the cabinet. When the supports are slid onto the rods, the cover sheet cannot be removed. The cover sheet can be used in conjunction with a condiment tray situated on the shelf and held in engagement with a vertical panel of the cabinet by means of flanged bushings on the cabinet in engagement with keyhole slots in a rear wall of the tray. The protective cover overlies the rear wall of the tray when the cover is in place, and prevents the keyhole slots from being disengaged from the flanged bushings.

9 Claims, 5 Drawing Sheets

FIG. 1
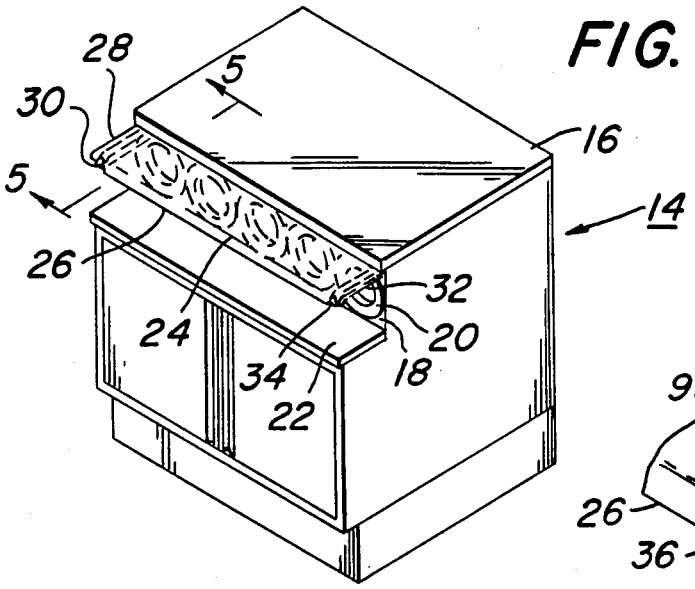
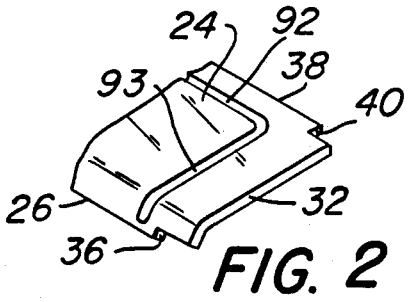
FIG. 2
FIG. 3
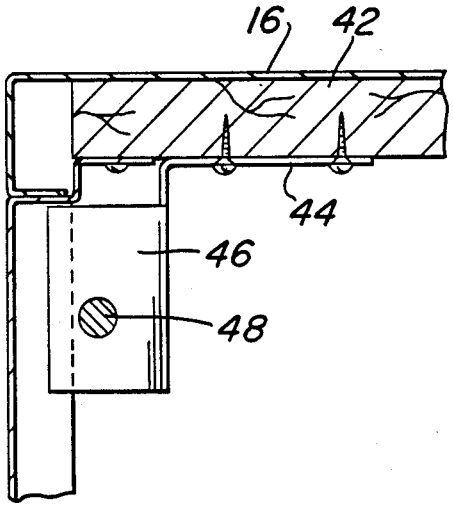
FIG. 4
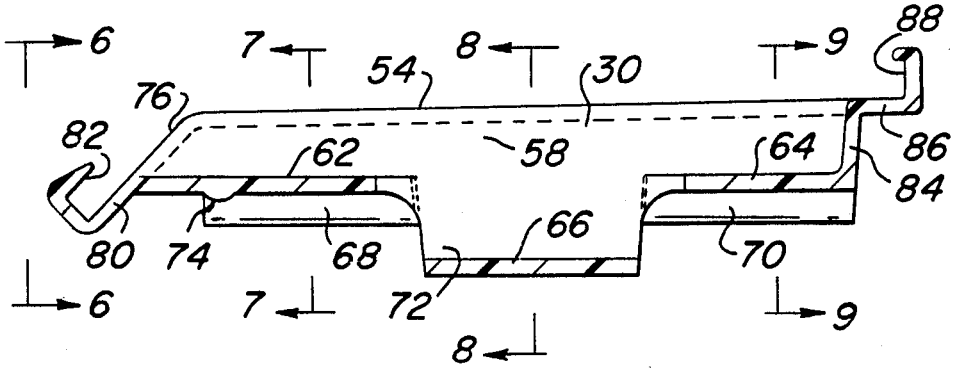

FIG. 6
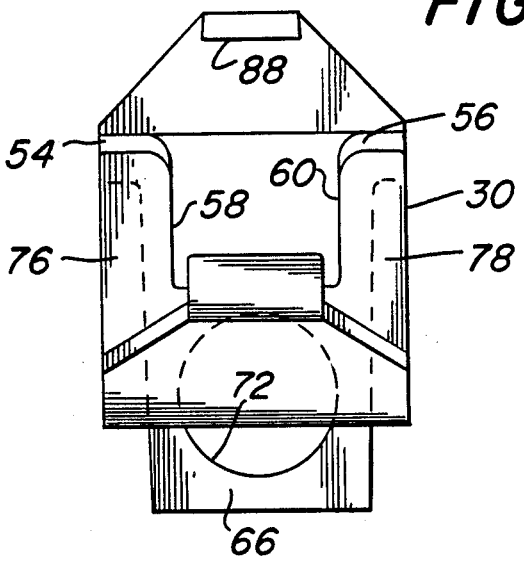
FIG. 7
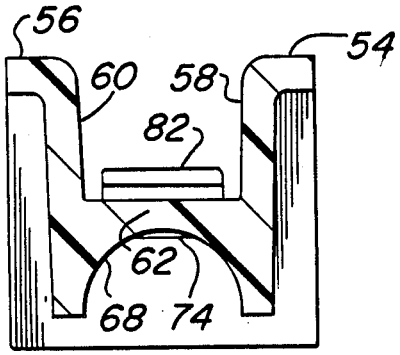
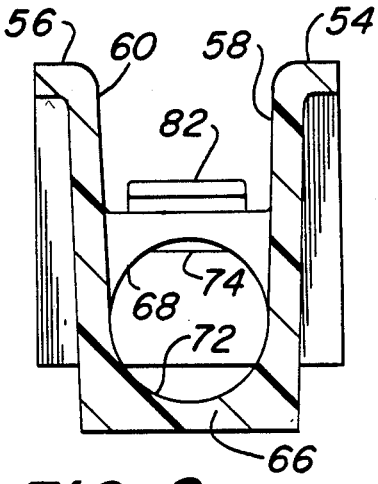
FIG. 8
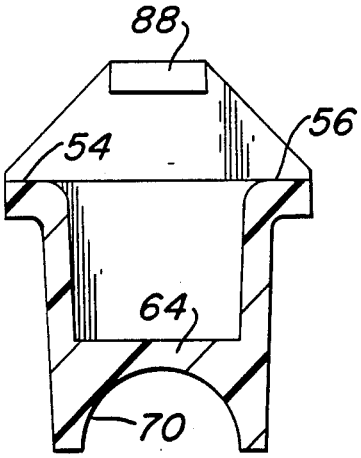
FIG. 9

STEP-FRONT CABINET WITH IMPROVED OVERHANGING COVER AND TRAY RETAINER

BRIEF SUMMARY OF THE INVENTION

This invention relates generally to cabinets, and more particularly to an improved protective cover for use with step-front cabinets of the type now widely used in convenience stores as self-service food preparation counters.

A step-front cabinet is a cabinet having a counter top and a stepped-down shelf located below the level of the counter top and extending forwardly of the front edge of the counter top. A step-front cabinet is described in U.S. Pat. No. 4,489,996, dated Dec. 25, 1984, the disclosure of which is incorporated by reference. Cabinets of this type have become very successful because they maximize available counter space by allowing cup dispensers to be positioned underneath the counter top, and because the step front protects the cups from damage caused by customers walking past the cup dispenser openings. Step-front cabinets of similar design are provided with divided trays on their stepped-down shelves, for holding condiments, plastic utensils, straws, cup covers, and similar articles. These trays are generally referred to as "condiment trays".

Whether the step-front cabinet is used with cup dispensers, or with a condiment tray, spillage is a problem. Consequently, step-front cabinets are usually provided with overhanging protectors which prevent liquids, food and the like from being spilled into the condiment tray or onto the cups projecting from the cup dispensers. In some cases, the overhanging protector is simply an extension of the counter top, which overhangs the stepped-down shelf. In other cases, the cabinet is designed to have a permanent transparent overhanging protector, which allows the cups, or the contents of the condiment tray to be viewed from above. Still others are provided with transparent protective covers which are separate structures secured to the cabinet by fasteners. In some cases, the transparent cover and the tray are constructed as a unit. With all of these protective covers, cleaning of the cabinet and the protective cover, is difficult.

The principal object of this invention is to provide a protective cover which is easily removable to allow cleaning of the shelf, and which is itself capable of being cleaned easily. Further objects are to provide such a protective cover in a form which is easily and inexpensively manufactured, and which is simple and easy to use. Still a further object of the invention is to provide a condiment tray for a step-front cabinet which is easily removable, but which is securely held on the cabinet shelf when the protective cover is in place.

In accordance with the invention, a pair of rods are rigidly secured to the cabinet, preferably by brackets secured to the underside of the counter top. These rods extend in spaced parallel relationship to each other forwardly of the front edge of the counter top and above the stepped-down shelf. The panel of the cabinet which extends downwardly from the front edge of the counter top to the shelf is provided with holes through which these rods extend.

A substantially rigid protective cover sheet, preferably of transparent polycarbonate or a similar polymer, is held by a pair of cover sheet supports, each of which is removably engageable with one of the rods. The supports have means for engaging the cover sheet and for preventing the cover sheet from becoming disengaged from the supports while the supports are engaged, and in a predetermined relationship, with the rods.

In a preferred form of the invention, the cover sheet supports have passages which receive the rods so that the supports can be brought into engagement with the rods by causing the forward ends of the rods to enter the passages of the supports, and thereafter sliding the supports rearwardly on the rods. The rods and supports preferably include cooperating means for holding the supports in a predetermined relationship with the rods. These cooperating means may comprise a reduced section on each rod, and projecting means, formed on each of the cover sheet supports, which snap into the reduced sections of the rods. Removal of the supports from the rods requires application of a predetermined forwardly directed force.

Preferably, each of the cover sheet supports has opposed front and rear grasping means for engaging the front and rear edges of the cover sheet. The supports are engaged with the cover sheet in a simple manner by sliding the supports onto the ends of the cover sheet. The cover sheet supports, while engaged with the cover sheet, are slid onto the rods until the projections snap into the reduced sections of the rods. The front and rear edges of the cover sheet are provided with step means which engage the supports to prevent sideways sliding of the cover sheet relative to the supports when the supports are engaged with the rods.

When a condiment tray is used, its rear panel, and the vertical panel of the cabinet which extends downwardly from the front edge of the counter top, are provided with cooperating means which require the condiment tray to be lifted upwardly for removal. The protective cover sheet overlies the upper edge of the vertical panel of the tray, and prevents removal of the tray so long as the cover sheet is engaged with the supports and the supports are engaged and in a predetermined relationship with the rods.

The structure of the invention has the advantage that it can be readily taken down into simple and easily cleaned parts without the need for disengagement of conventional fasteners such as screws, pins and the like. Further objects and advantages of the invention will be apparent from the following detailed description when read in conjunction with the drawings.

BRIEF DESCRIPTION OF THE DRAWINGS

FIG. 1 is a perspective view of a step-front cabinet having cup dispensers and a protective overhanging cover in accordance with the invention;

FIG. 2 is a fragmentary perspective view showing one end of the protective cover, and particularly showing the stepped front and rear edges of the cover;

FIG. 3 is a fragmentary vertical section of the cabinet, as seen through plane 3—3 of FIG. 5;

FIG. 4 is a vertical section through one of the cover sheet supports;

FIGS. 6, 7, 8 and 9 are transverse vertical sections of the cover sheet support of FIG. 4, as seen through the correspondingly numbered planes indicated in FIG. 4;

DETAILED DESCRIPTION

Figure 5:
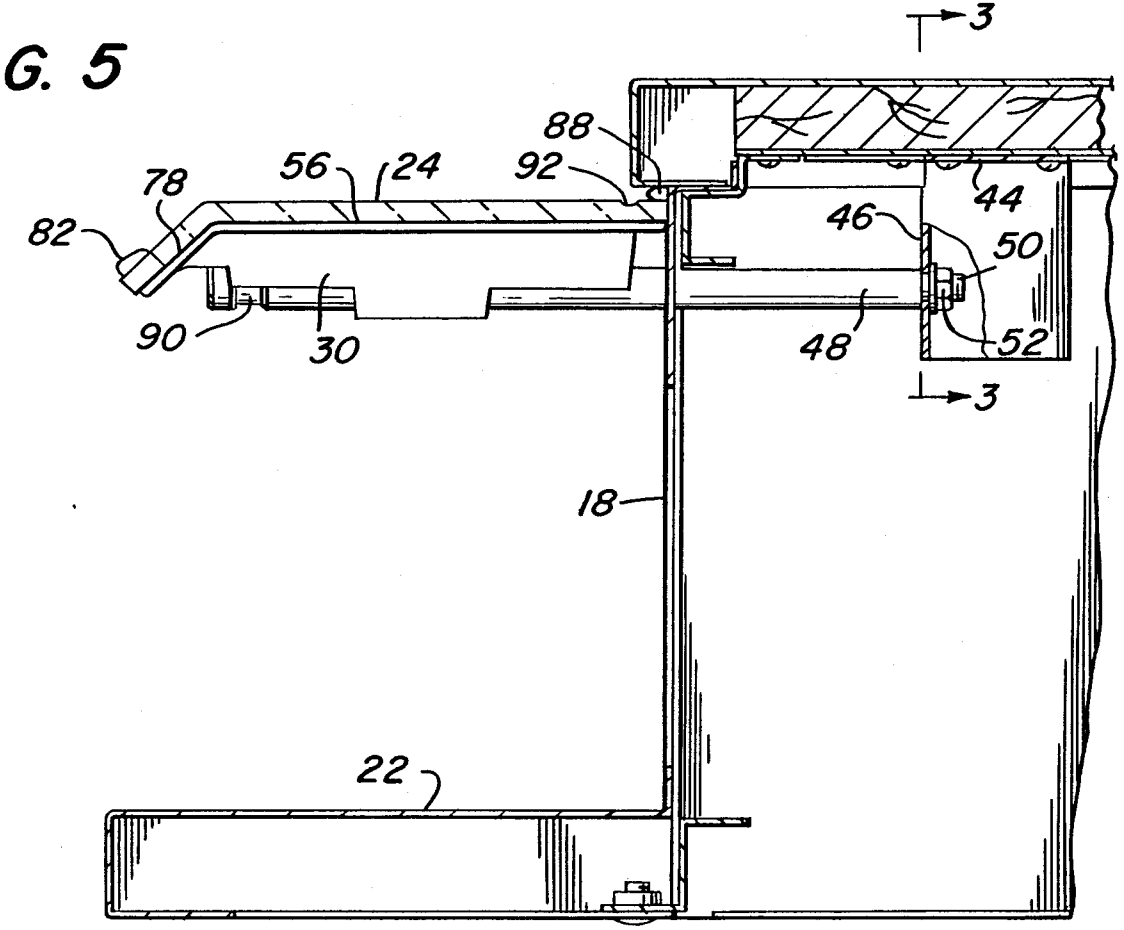
FIG. 5 is a fragmentary vertical section of the cabinet as seen through plane 5—5 of FIG. 1.

As shown in FIG. 1, cabinet 14 has a counter top 16, and a vertical panel 18 extending downwardly from a location adjacent to the front edge of top 16. Cup dispensers 20 extend horizontally underneath the counter top, and are accessible through openings provided in panel 18. Stepped-down shelf 22 extends forwardly from panel 18 at a level sufficiently below the level of counter top 16 to provide space for cups (not shown) which project forwardly from the cup dispenser openings. Preferably, the depth of shelf 22 is such that the cups do not extend beyond its front edge. This is not critical, however. In many cases, large capacity cups extend slightly beyond the front edge of the stepped-down shelf.

A transparent polycarbonate sheet 24 extends forwardly from an upper portion of panel 18, and overhangs shelf 22 to provide protection for the cups against spillage, while maintaining visibility so that customers can easily reach and remove cups from the cup dispenser. Sheet 24 has a downturned forward edge. Sheet 24 is supported near its left edge 28 by a support 30, and near its right edge 32 by a support 34.

As shown in FIG. 2, front edge 26 of sheet 24 is stepped inwardly near its right edge 32 to provide a rightwardly facing step surface 36. Rear edge 38 of the sheet is similarly stepped inwardly near right edge 32 to provide a rightward facing step surface 40. Similar steps (not shown) are provided near the left edge 28 of sheet 24.

As shown in FIG. 3, counter top 16 comprises a metal sheet (preferably stainless steel) having a wood or particle board sheet 42 directly underneath the sheet metal. A bracket 44, located underneath the counter top is secured to board 42 by screws. The bracket has a flange 46, to which is secured a forwardly projecting rod 48. Bracket 44 and rod 48 are located near the left side of the cabinet. A similar bracket and rod (not shown) are located near the right side of the bracket.

As shown in FIG. 5, rod 48 projects through panel 18, a hole (not shown) being provided for this purpose in the panel. The rod has threads 50 at its rearward end, and is secured to flange 46 of bracket 44 by a nut 52. The rod is intended to remain permanently in place, even when the protective cover is removed for cleaning.

Supports 30 and 34, at the left and right ends respectively of sheet 24 in FIG. 1, are preferably, but not necessarily, identical. Therefore, only support 30 will be described in detail. Support 30, as shown in FIGS. 4, 6, 7, 8 and 9, is a unitary molded polymeric element, preferably of polycarbonate or a similar material. It is formed with a pair of parallel ridges 54 and 56, which are engageable with the underside of protective sheet 24, and which support the sheet. Ridge 54 is formed at the upper edge of a side wall 58, and ridge 56 is similarly provided at the upper edge of a side wall 60. The side walls are connected together by a front bottom wall 62, a rear bottom wall 64, and an intermediate bottom wall 66, which is located below the level of bottom walls 62 and 64.

Bottom wall 62 is formed with a rounded cylindrical underside 68, and bottom wall 64 is similarly formed with a rounded cylindrical underside 70. These rounded undersides preferably conform to the curvature of rod 48. The upper side of intermediate bottom wall 66 has a similar curved surface 72, which also conforms to the rod. Surfaces 68, 70 and 72, together, form a passage which is capable of tightly receiving rod 48.

The underside surface 68 of front bottom wall 62 is provided with a projection 74, which enters a reduced section of the rod to hold the support in place on the rod.

The front of ridge 54 is provided with a sloping part 76, and the front of ridge 56 (FIG. 6) is provided with a similar sloping part 78. Wall 62 is similarly bent downwardly to form a sloping part 80, which lies in the same plane with sloping parts 76 and 78. A hook-shaped cover sheet retainer 82 is formed at the lower end of part 80. The sheet retainer provides a rectangular slot conforming to the front edge of sheet 24, and capable of grasping the sheet.

Rear bottom wall 64 is provided with an upwardly bent rear wall portion 84. At the upper end of portion 84 is a rearwardly extending member 86 terminating in a hook-shaped cover sheet retainer 88 similar to retainer 82. Cover sheet retainers 82 and 88 are spaced from each other by a distance such that they are capable of receiving the stepped-in portions at the left or right ends of the cover sheet, as illustrated in FIG. 2, but engage the step surfaces 36 and 40 to prevent sideways sliding of the cover sheet relative to the supports.

As shown in FIG. 5, cover sheet 24 is held between retainers 82 and 88 at the front and rear ends respectively of support 30. Rod 48 is provided near its front end with a chamfered groove 90, which receives projection 74 (FIG. 4) to hold the support on the rod. Projection 74 snaps into groove 90 when the support is slid rearwardly onto the rod to a position such that rear retainer closely approaches, or contacts panel 18. The snapping action of projection 74 into groove 90 occurs as a result of the inherent resilience of the portion of support 30 between projection 74 and bottom wall 66. The support can be removed from the rod by the application of a moderate force in the forward direction, sufficient to cause projection 74 to move out of groove 90 of the rod.

Sheet 24 is provided with a groove 92, the major part of which extends parallel to rear edge 38, and having forwardly turned end portions, one of which is indicated at 93 in FIG. 2. The groove conducts liquids which are spilled onto protective sheet 24 toward the left and right edges 28 and 32 of the sheet, and then forwardly over the front end of the sheet. Spilled liquids are thereby prevented from flowing over the rear edge 38 of the sheet and downwardly onto cups projecting through panel 18.

Figure 10:
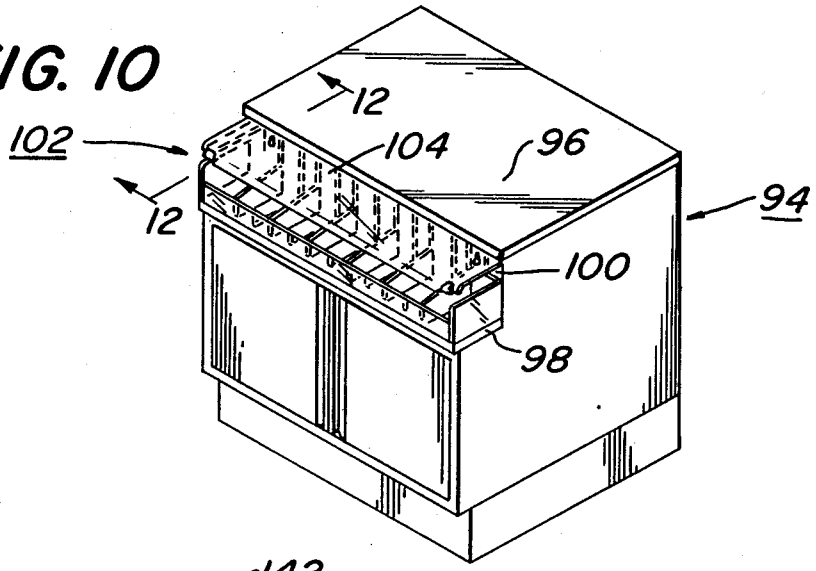
FIG. 10 is a perspective view of a step-front cabinet provided with a condiment tray and a protective overhanging cover in accordance with the invention.
Figure 11:
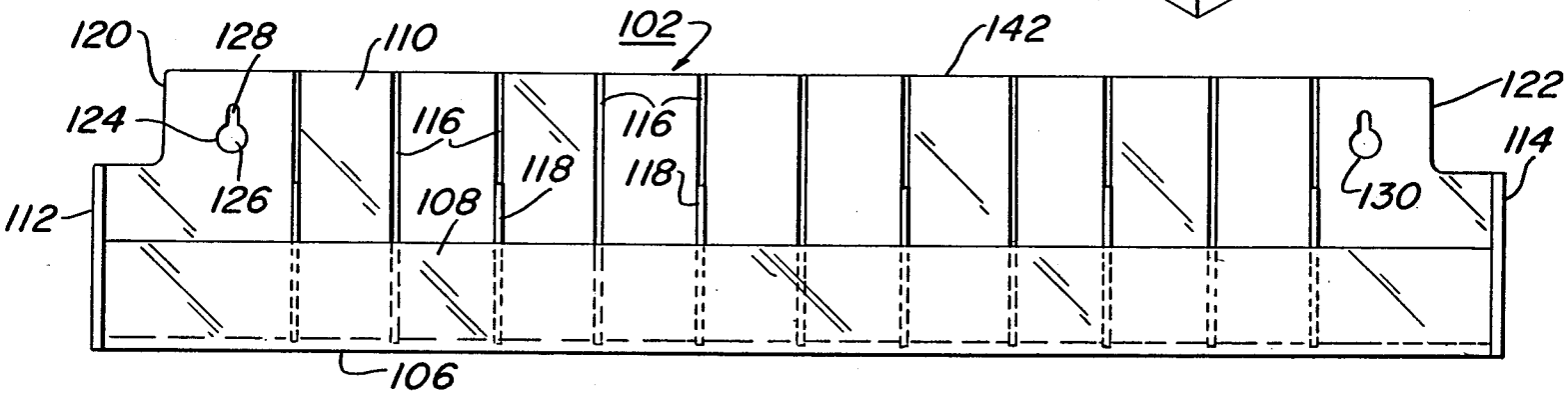
FIG. 11 is a front elevational view of the condiment tray of FIG. 10.
Figure 12:
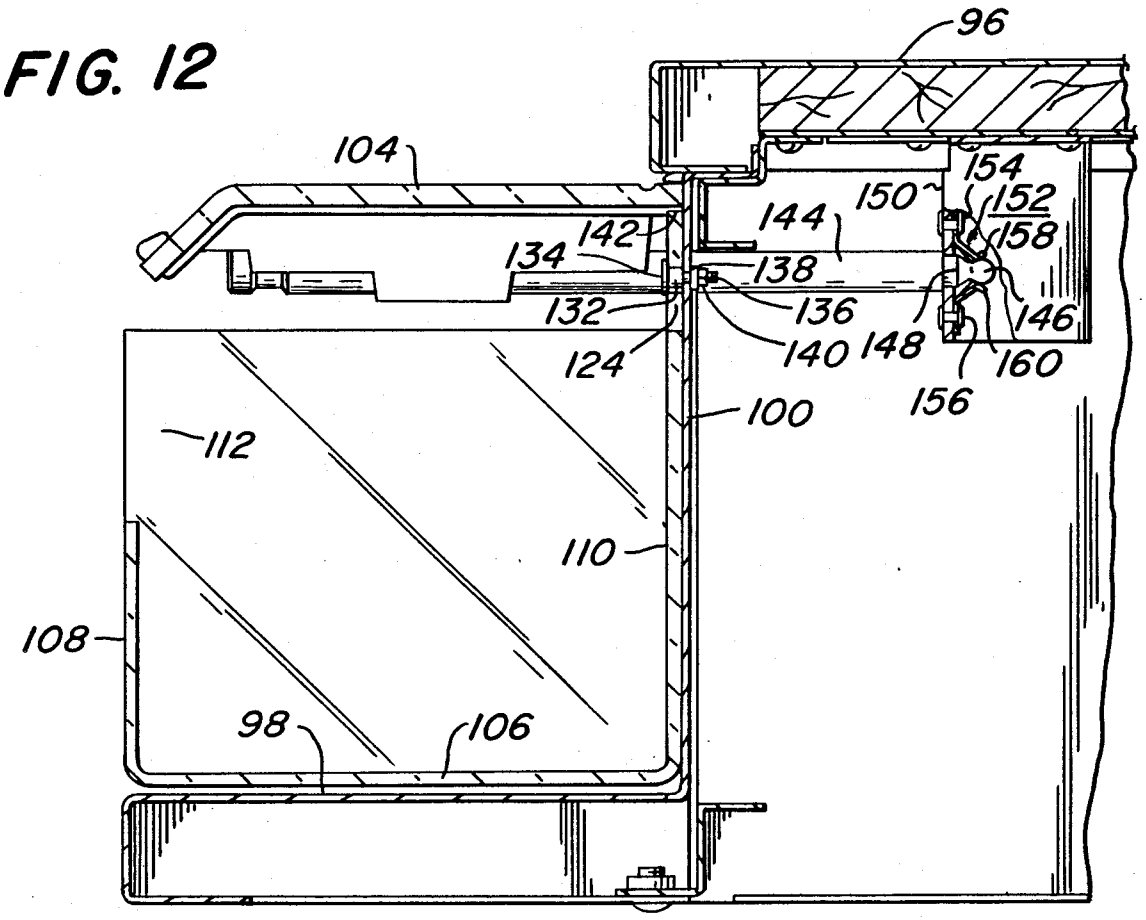
FIG. 12 is a fragmentary vertical section as seen through plane 12—12 of FIG. 10.

FIGS. 10, 11 and 12 show the embodiment of the invention in which the protective cover is used in conjunction with a condiment tray.

Cabinet 94 in FIG. 10 is very similar to cabinet 14 of FIG. 1. Cabinet 94 has a counter top 96 and a step-down shelf 98, which extends forwardly from a panel 100 at a level sufficiently below the level of top 96 to allow room for the placement of a condiment tray 102 on the shelf. Panel 100 does not have provisions for cup dispensers. However, it does have holes for protective cover supporting rods similar to those used in the FIG. 1 embodiment. A protective cover 104, which can be identical to cover 24, overhangs shelf 98, and protects the contents of tray 102 from contamination by spilled liquids and the like.

The condiment tray, as shown in FIG. 11 is formed from transparent acrylic polymer, or similar material, and has a bottom wall 106, a short front wall 108, and a tall rear wall 110, all of which walls are formed from a single sheet. End walls 112 and 114 are attached by cementing or fusing the material. Slots are provided in the back, bottom and front walls at 116, and dividers 118 are provided in selected slots.

The upper left and upper right corners of rear wall 110 are provided with rectangular notches at 120 and 122 to accommodate the rods and the protective sheet supports which are held on the rods. A keyhole opening 124 is provided in rear wall 110 adjacent the notch 120. This keyhole opening has a large round lower portion 126, and a narrower upper portion 128. A similar keyhole opening is provided at 130 near the right-hand end of rear wall 110.

Referring to FIG. 12, a plastic bushing 132, having a flange 134 is secured to panel 100 by a screw 136, a washer 138 and a nut 140. Bushing 132 is located on panel 100 at a position such that its flange 134 can enter the enlarged lower portion 126 of keyhole 124 while the bottom wall 106 of the tray is slightly above the surface of shelf 98. Another similar bushing (not shown) is similarly situated near the opposite end of panel 100 to be received in the lower portion of keyhole 130. When the tray is positioned so that the bushings enter the keyholes, and then lowered, the bushings enter the narrow upper portions of the keyholes, as shown in FIG. 12, and the flanges on the bushings hold the rear wall 110 of the tray against panel 100. The lengths of the bushings are such that their flanges are spaced from panel 100 by a distance substantially equal to the thickness of rear wall 110 of the tray. Furthermore, the diameters of the bushings are preferably substantially equal to the widths of the narrow upper portions of the keyhole openings. Consequently, when the tray hangs on the plastic bushings, it is securely held against horizontal movement.

Rod 144 and its opposite counterpart (not shown) may be secured to their supporting brackets by nuts, as in FIG. 5, or alternatively by means of ball stud fasteners as shown in FIG. 12. The use of a ball stud fastener has the advantage that it enables the rod to be easily removed for cleaning.

As shown in FIG. 12, rod 144 has a ball 146 machined at its rear end. A reduced cylindrical portion 148, also machined in the rod near its rear end, fits snugly into a hole in the bracket 150. A ball stud fastener 152 is secured to the rear face of bracket 150 by rivets 154 and 156. The fastener is a spring steel element having spring legs 158 and 160 which bear inwardly on the ball and hold rod 144 firmly in engagement with bracket 150. Suitable ball stud fasteners, known as TINNERMAN ball stud fasteners are available from Eaton Corporation, Engineered Fasteners Operations, Cleveland Division, P.O. Box 6688, Cleveland, Ohio 44101.

When protective sheet 104 is in place, as shown in FIG. 12, its underside overlies, and is in close proximity to, the upper edge 142 of rear wall 110 of the tray. The stepped ends of the rear edge of the protective cover (as shown in FIG. 2) make it possible for the rear edge of the cover to be situated in close proximity to panel 100, and thereby overlie the upper edge of rear wall 110 of the tray. When the protective cover 104 is in the position shown in FIG. 12, the tray cannot be lifted far enough to release it from the bushings. Consequently, the tray is conveniently secured to the shelf in a very simple manner. The entire assembly shown in FIG. 12 can be taken apart for cleaning readily simply by pulling on the cover sheet supports to remove them from the rods, sliding the supports off the ends of the cover sheet, and then lifting and removing the condiment tray. The rods may also be removed for cleaning. After cleaning, the above steps are simply reversed. These operations can be carried out very quickly, particularly as there is no need to loosen and remove screws or other fasteners, and no need for special tools. The same protective cover, rods and supports can be used in both versions of the invention, and the left and right-hand supports can be identical to each other. The supports and rods can be standardized, and used with cabinets of any width. The protective covers are, of course, easily cut to any desired length, and the stepped ends at their front and rear edges are easily formed. Thus, the invention makes it possible to provide protective covers for a wide variety of cabinets very economically.

Various modifications can be made to the apparatus described above. For example, while the cover sheet is preferably shaped with a downturned forward edge, cover sheets may take various shapes. For example, a flat cover sheet, or one with an upturned forward edge can be used. The configuration of the supports may be modified accordingly. The configurations of the edges of the cover sheets, and of the rods may likewise be modified in numerous respects. In the embodiment of FIGS. 10–12, the condiment tray can be designed to rest on the stepped-down shelf and nevertheless be secured against horizontal movement by engagement of its keyhole slots with the plastic bushings projecting forwardly from panel 100. Still further modifications can be made without departing from the scope of the invention as defined in the following claims.

We claim:

1. A protective cover structure comprising a pair of rods extending in spaced parallel relationship to each other, a substantially rigid sheet, a pair of supports, each being removably engageable with one of said rods, and means on said supports for engaging said sheet, for preventing said sheet from becoming disengaged from the supports while the supports are engaged, and in a predetermined relationship, with said rods and for permitting the sheet to become disengaged from the supports when the supports are disengaged from said rods, in which each of said rods has a forward end and in which each of said supports has means providing a passage for receiving one of said rods whereby the support can be brought into said predetermined relationship with its rod by causing the forward end of the rod to enter the passage of the support and thereafter sliding the support rearwardly on the rod.

2. In combination with a step-front cabinet comprising a counter top having a front edge and a shelf located below the level of the counter top and extending forwardly of said front edge, an improved overhanging cover for said shelf comprising:

a pair of rods rigidly secured to the cabinet and extending, in spaced parallel relationship to each other forwardly of said front edge and above said shelf;

a substantially rigid cover sheet;

a pair of cover sheet supports, each being removably engageable with one of said rods; and means on said supports for engaging said cover sheet, for preventing the cover sheet from becoming disengaged from the supports while the supports are engaged, and in a predetermined relationship, with said rods and for permitting the cover sheet to become disengaged from the supports when the supports are disengaged from said rods;

in which each of said rods has a forward end and in which each of said cover sheet supports has means providing a passage for receiving one of said rods whereby the support can be brought into said predetermined relationship with its rod by causing the forward end of the rod to enter the passage of the support and thereafter sliding the support rearwardly on the rod.

3. In combination with a step-front cabinet comprising a counter top having a front edge and a shelf located below the level of the counter top and extending forwardly of said front edge, an improved overhanging cover for said shelf comprising:

a pair of rods rigidly secured to the cabinet and extending, in spaced parallel relationship to each other forwardly of said front edge and above said shelf;

a substantially rigid cover sheet;

a pair of cover sheet supports, each being removably engageable with one of said rods; and means on said supports for engaging said cover sheet, for preventing the cover sheet from becoming disengaged from the supports while the supports are engaged, and in a predetermined relationship, with said rods and for permitting the cover sheet to become disengaged from the supports when the supports are disengaged from said rods;

in which the step-front cabinet has a cabinet panel extending downwardly from a location adjacent to the front edge of the counter top to the shelf, said cabinet panel having a pair of holes, and in which the rods are rigidly secured to the cabinet at locations underneath the counter top and behind the panel and each rod extends forwardly through one of said holes.

4. The combination in accordance with claim 2 including cooperating means on said rods and on said supports for holding the supports in said predetermined relationship with the rods.

5. The combination in accordance with claim 4 in which said cooperating means comprise a reduced section on each of said rods, and means formed on each of said cover sheet supports for projecting into the reduced section of its corresponding rod, in which at least a part of each support means between the projecting means and a portion of the passage-providing means is resilient, whereby the projecting means of each support snaps into the reduced section of its rod when the support is moved to said predetermined relationship, and in which said projecting means and recess are shaped to permit their disengagement by applying a predetermined forwardly directed force to the support.

6. The combination according to claim 2 in which the cover sheet has a front edge, a left edge and a right edge, in which each of the supports includes grasping means for engaging the front edge of the cover sheet and preventing the front edge of the cover sheet from moving upwardly, downwardly and forwardly.

7. In combination with a step-front cabinet comprising a counter top having a front edge and a shelf located below the level of the counter top and extending forwardly of said front edge, an improved overhanging cover for said shelf comprising:

a pair of rods rigidly secured to the cabinet and extending, in spaced parallel relationship to each other forwardly of said front edge and above said shelf;

a substantially rigid cover sheet;

a pair of cover sheet supports, each being removably engageable with one of said rods; and means on said supports for engaging said cover sheet, for preventing the cover sheet from becoming disengaged from the supports while the supports are engaged, and in a predetermined relationship, with said rods and for permitting the cover sheet to become disengaged from the supports when the supports are disengaged from said rods;

in which the cover sheet has a front edge, a rear edge, a left edge and a right edge, in which each of the supports includes opposed front and rear grasping means for engaging the front and rear edges of the cover sheet and preventing the cover sheet from moving relative to the support in all directions other than directions parallel to the front and rear edges of the cover sheet, one support being engageable with the cover sheet by sliding the left edge of the cover sheet into the space between the grasping means of said one support, and the other support being engageable with the cover sheet by sliding the right edge of the cover sheet into the space between the grasping means of the other support.

8. The combination according to claim 7 in which at least one of the front and rear edges of the cover sheet is provided with step means for engaging one of said supports and at least one of the front and rear edges of the cover sheet is provided with step means for engaging the other of said supports, said step means cooperating with said supports to prevent sliding of the cover sheet relative to the supports in directions parallel to the front and rear edges of the cover sheet when the supports are engaged, and in said predetermined relationship with said rods.

9. In combination with a step-front cabinet comprising a counter top having a front edge and a shelf located below the level of the counter top and extending forwardly of said front edge, an improved overhanging cover for said shelf comprising:

a pair of rods rigidly secured to the cabinet and extending, in spaced parallel relationship to each other forwardly of said front edge and above said shelf;

a substantially rigid cover sheet;

a pair of cover sheet supports, each being removably engageable with one of said rods; and means on said supports for engaging said cover sheet, for preventing the cover sheet from becoming disengaged from the supports while the supports are engaged, and in a predetermined relationship, with said rods and for permitting the cover sheet to become disengaged from the supports when the supports are disengaged from said rods;

in which the step-front cabinet has a cabinet panel extending downwardly from a location adjacent to the front edge of the counter top to the shelf, and including a tray adapted to rest on said shelf, the tray having a rear tray panel adapted to lie against said cabinet panel, said tray panel having an upper edge, and cooperating means on said panels for securing the rear tray panel against said cabinet panel and requiring an upward sliding movement of the rear tray panel against the cabinet panel in order to disengage the tray from the cabinet, and in which the cover sheet closely overlies the upper edge of the rear tray panel when the cover sheet is engaged with the supports and the supports are engaged, and in said predetermined relationship, with said rods, whereby said upward sliding movement of the rear tray panel is inhibited and removal of the tray from the shelf is prevented.

* * * * *